US011384310B2

(12) United States Patent
Horita et al.

(10) Patent No.: US 11,384,310 B2
(45) Date of Patent: Jul. 12, 2022

(54) LUBRICATING OIL COMPOSITION AND PRODUCTION METHOD THEREFOR

(71) Applicant: IDEMITSU KOSAN CO., LTD., Chiyoda-ku (JP)

(72) Inventors: Naoto Horita, Funabashi (JP); Hiroshi Oki, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 17/058,890

(22) PCT Filed: May 28, 2019

(86) PCT No.: PCT/JP2019/021011
§ 371 (c)(1),
(2) Date: Nov. 25, 2020

(87) PCT Pub. No.: WO2019/230689
PCT Pub. Date: Dec. 5, 2019

(65) Prior Publication Data

US 2021/0198592 A1 Jul. 1, 2021

(30) Foreign Application Priority Data

May 29, 2018 (JP) ..... JP2018-102381

(51) Int. Cl.

| | |
|---|---|
| ***C10M 169/04*** | (2006.01) |
| ***C10M 129/50*** | (2006.01) |
| ***C10M 133/12*** | (2006.01) |
| ***C10M 133/44*** | (2006.01) |
| ***C10M 135/10*** | (2006.01) |
| ***C10M 137/10*** | (2006.01) |
| ***C10M 141/10*** | (2006.01) |
| *C10N 30/00* | (2006.01) |
| *C10N 40/25* | (2006.01) |
| *C10N 30/04* | (2006.01) |

(52) U.S. Cl.
CPC ..... *C10M 169/04* (2013.01); *C10M 129/50* (2013.01); *C10M 133/12* (2013.01); *C10M 133/44* (2013.01); *C10M 135/10* (2013.01); *C10M 137/10* (2013.01); *C10M 141/10* (2013.01); *C10M 2203/003* (2013.01); *C10M 2207/141* (2013.01); *C10M 2215/26* (2013.01); *C10M 2215/30* (2013.01); *C10M 2219/044* (2013.01); *C10M 2223/045* (2013.01); *C10N 2030/04* (2013.01); *C10N 2030/40* (2020.05); *C10N 2040/255* (2020.05)

(58) Field of Classification Search
CPC ..... C10M 169/04; C10M 129/50; C10M 133/12; C10M 133/44; C10M 135/10; C10M 137/10; C10M 141/10; C10M 2203/003; C10M 2207/141; C10M 2215/26; C10M 2215/30; C10M 2219/044; C10M 2223/045; C10N 2030/40; C10N 2040/255; C10N 2030/04
See application file for complete search history.

(56) References Cited

U.S. PATENT DOCUMENTS

| | | | | |
|---|---|---|---|---|
| 4,338,205 | A * | 7/1982 | Wisotsky | C10M 1/08 508/188 |
| 4,867,890 | A * | 9/1989 | Colclough | C10M 167/00 508/192 |
| 4,952,328 | A * | 8/1990 | Davis | C10M 133/52 508/237 |
| 5,614,480 | A * | 3/1997 | Salomon | C10M 167/00 508/287 |

(Continued)

FOREIGN PATENT DOCUMENTS

| | | |
|---|---|---|
| EP | 2 610 333 B1 | 8/2021 |
| JP | 2003-165991 A | 6/2003 |

(Continued)

OTHER PUBLICATIONS

Indian Office Action dated Feb. 8, 2022 in Indian Patent Application No. 202047051041, 6 pages.
Office Action dated Sep. 8, 2021 in corresponding Singapore Patent Application No. 11202011686W, citing document AO therein, 7 pages.
International Search Report dated Aug. 13, 2019 in PCT/JP2019/021011 filed on May 28, 2019, citing documents AA-AC and AO-AS and AV therein, 2 pages.

(Continued)

*Primary Examiner* — Cephia D Toomer
(74) *Attorney, Agent, or Firm* — Oblon, McClelland, Maier & Neustadt, L.L.P.

(57) ABSTRACT

The present invention relates to a lubricating oil composition to be used for internal combustion engines, the lubricating oil composition containing a base oil (A), an imide compound (B) that is at least one selected from a succinic acid monoimide (B1) represented by the general formula (b-1) and a succinic acid bisimide (B2) represented by the foregoing general formula (b-2), a metal-based detergent (C) that is at least one selected from a metal sulfonate (C1) having a branched alkyl group and a metal phenate (C2) having a branched alkyl group, and a zinc dithiophosphate (D), wherein the content of a phosphorus atom derived from the component (D) is less than 800 ppm by mass on the basis of the total amount of the lubricating oil composition; and a method for producing the same. The present invention is able to provide a lubricating oil composition in which even in the case where the content of a phosphorus atom derived from an anti-wear agent is reduced, it is possible to reveal excellent wear resistance in an internal combustion engine and a high friction coefficient in a wet clutch; and a method for producing the same.

20 Claims, No Drawings

(56) References Cited

U.S. PATENT DOCUMENTS

| | | | | |
|---|---|---|---|---|
| 5,629,272 | A * | 5/1997 | Nakazato | C10M 159/20 508/185 |
| 2012/0132166 | A1 | 5/2012 | Andoh et al. | |
| 2013/0237465 | A1 | 9/2013 | Andoh et al. | |
| 2015/0099676 | A1 | 4/2015 | Brown et al. | |

FOREIGN PATENT DOCUMENTS

| | | | |
|---|---|---|---|
| JP | 2004-269707 | A | 9/2004 |
| JP | 2012-131986 | A | 7/2012 |
| JP | 2013-133453 | A | 7/2013 |
| JP | 2013-185087 | A | 9/2013 |
| JP | 2015-512457 | A | 4/2015 |
| JP | 2018-65924 | A | 4/2018 |
| WO | WO 2009/118984 | A1 | 10/2009 |

OTHER PUBLICATIONS

Japanese Office Action dated Feb. 1, 2022 in Japanese Patent Application No. 2018-102381 (with unedited computer generated English translation), 9 pages.

* cited by examiner

LUBRICATING OIL COMPOSITION AND PRODUCTION METHOD THEREFOR

TECHNICAL FIELD

The present invention relates to a lubricating oil composition and a method for producing the same.

BACKGROUND ART

A system for lubricating a lubricating oil for engine and a lubricating oil for power transmission in a motorcycle equipped with a wet clutch or the like by the same oil is needed to be provided with a performance as the lubricating oil for power transmission in addition to a performance required as the lubricating oil for engine.

Specifically, the lubricating oil for engine is required to have various characteristics, such as wear resistance, detergency, heat resistance, oxidation stability, low oil consumption, and low friction loss. Meanwhile, in order to improve a fuel-saving performance of a power transmission apparatus, such as a transmission, an improvement of power transmission efficiency and downsizing and lightening are required, and in particular, from the viewpoint of insurance of a clutch capacity and lightening of a clutch, it is required to increase a friction coefficient between a clutch disc and a clutch plate.

PTL 1 discloses, as a lubricating oil for internal combustion engine, which is excellent in attaining a high friction coefficient in a wet clutch in addition to a performance required for an engine system, a lubricating oil composition for internal combustion engine containing (a) a zinc dialkyl dithiophosphate and (b) a boron-containing ash-free dispersant, in which the phosphorus amount is limited to a specified range.

PTL 2 discloses, as a lubricating oil composition capable of satisfying both a high clutch capacity and a long anti-shudder lifetime, a lubricating oil composition containing a succinimide having an alkenyl group or an alkyl group, a primary amine having a hydrocarbon group having 12 or more and 24 or less carbon atoms, a fatty acid amide compound, and a specified amide compound.

CITATION LIST

Patent Literature

PTL 1: JP 2004-269707 A
PTL 2: JP 2018-065924 A

SUMMARY OF INVENTION

Technical Problem

Now, as a method for improving the wear resistance of a lubricating oil, a method of adding an anti-wear agent containing a phosphorus atom, such as a zinc dithiophosphate, is widely applied. However, it becomes clear that the phosphorus atom poisons an exhaust gas catalyst, such as platinum, which is installed for the purpose of removing noxious substances in an exhaust gas of an automobile or the like. In recent years, from the viewpoint of global environment protection, the exhaust gas regulations are becoming increasingly strict, and measures to inhibit poisoning the exhaust gas catalyst by reducing the content of the phosphorus atom in the lubricating oil for engine is required.

In the lubricating oil compositions described in PTLs 1 and 2, even in the case of reducing the content of the phosphorus atom derived from the anti-wear agent (specifically, the case of controlling the content of the phosphorus atom derived from the anti-wear agent to less than 800 ppm by mass on the basis of the total amount of the lubricating oil composition), sufficient studies are not made from the viewpoint of revealing excellent wear resistance and a high friction coefficient of clutch in an internal combustion engine, and improvements in these performances are desired.

In view of the aforementioned problem, the present invention has been made, and an object thereof is to provide a lubricating oil composition which even in the case of reducing the content of the phosphorus atom derived from the anti-wear agent, is capable of revealing excellent wear resistance in an internal combustion engine and a high friction coefficient in a wet clutch, and a method for producing the same.

Solution to Problem

The present inventors have found that the aforementioned problem can be solved by a lubricating oil composition containing a base oil, an imide compound having a specified structure, a metal-based detergent having a specified structure, and a zinc thiophosphate and a method for producing the same, thereby leading to accomplishment of the present invention.

Specifically, the present invention provides the following [1] to [10].

[1] A lubricating oil composition to be used for internal combustion engines, the lubricating oil composition containing a base oil (A), an imide compound (B) that is at least one selected from a succinic acid monoimide (B1) represented by the following general formula (b-1) and a succinic acid bisimide (B2) represented by the following general formula (b 2):

(b-1)

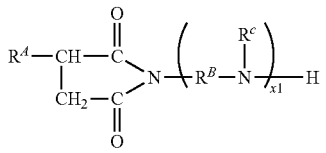

(b-2)

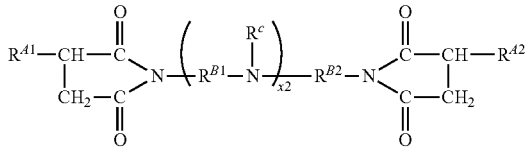

wherein, $R^A$, $R^{A1}$, and $R^{A2}$ are each independently an alkenyl group having a mass average molecular weight (Mw) of 500 to 4,000, $R^B$, $R^{B1}$, and $R^{B2}$ are each independently an alkylene group having 2 to 5 carbon atoms, $R^C$ is an alkyl group having 1 to 10 carbon atoms or a group represented by $-(AO)_n—H$, wherein A represents an alkylene group having 2 to 4 carbon atoms, and n represents an integer of 1 to 10, and x1 is an integer of 1 to 10, and x2 is an integer of 1 to 10, a metal-based detergent (C) that is at least one selected from a metal sulfonate (C1) having a branched alkyl group and a metal phenate (C2) having a branched alkyl group, and a zinc dithiophosphate (D), wherein the content of a phosphorus atom derived from the component (D) is less than 800 ppm by mass on the basis of the total amount of the lubricating oil composition.

[2] The lubricating oil composition as set forth in the above [1], wherein the content of the component (B) as expressed in terms of a nitrogen atom is 100 to 1,000 ppm by mass on the basis of the total amount of the lubricating oil composition.

[3] The lubricating oil composition as set forth in the above [1] or [2], wherein the total content of a succinic acid monoimide represented by the following general formula (i) and a succinic acid bisimide represented by the following general formula (ii) is less than 10 parts by mass based on 100 parts by mass of the total amount of the component (B):

(i)

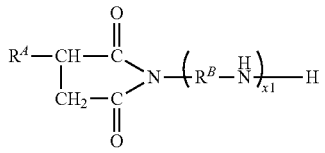

(ii)

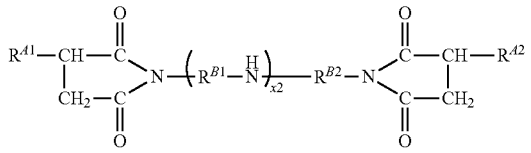

wherein, $R^A$, $R^{A1}$, $R^{A2}$, $R^B$, $R^{B1}$, $R^{B2}$, x1, and x2 are the same as in the general formulae (b-1) and (b-2).

[4] The lubricating oil composition as set forth in any one of the above [1] to [3], wherein the content of the component (C) as expressed in terms of a metal atom is 100 to 5,000 ppm by mass on the basis of the total amount of the lubricating oil composition.

[5] The lubricating oil composition as set forth in any one of the above [1] to [4], wherein a content ratio [N/M] of the nitrogen atom (N) derived from the component (B) to the metal atom (M) derived from the component (C) is 0.05 to 2.00 in terms of a mass ratio.

[6] The lubricating oil composition as set forth in any one of the above [1] to [5], wherein the component (C) is at least one selected from a calcium sulfonate having a branched alkyl group and a calcium phenate having a branched alkyl group.

[7] The lubricating oil composition as set forth in any one of the above [1] to [6], wherein the content of a metal-based detergent having a linear alkyl group is less than 10 parts by mass based on 100 parts by mass of the total amount of the component (C).

[8] The lubricating oil composition as set forth in any one of the above [1] to [7], wherein the content of a molybdenum atom is less than 50 ppm by mass on the basis of the total amount of the lubricating oil composition.

[9] The lubricating oil composition as set forth in any one of the above [1] to [8], which is used for internal combustion engines for motorcycle.

[10] A method for producing a lubricating oil composition to be used for internal combustion engines, the method including mixing a base oil (A), an imide compound (B) that is at least one selected from a succinic acid monoimide (B1) represented by the following general formula (b-1) and a succinic acid bisimide (B2) represented by the following general formula (b-2):

(b-1)

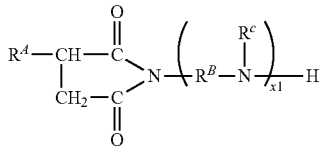

(b-2)

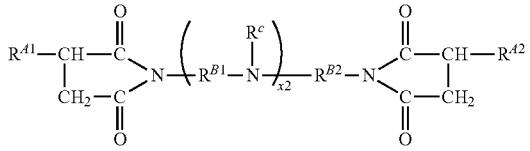

wherein, $R^A$, $R^{A1}$, and $R^{A2}$ are each independently an alkenyl group having a mass average molecular weight (Mw) of 500 to 4,000, $R^B$, $R^{B1}$, and $R^{B2}$ are each independently an alkylene group having 2 to 5 carbon atoms, $R^C$ is an alkyl group having 1 to 10 carbon atoms or a group represented by $-(AO)_n—H$, wherein A represents an alkylene group having 2 to 4 carbon atoms, and n represents an integer of 1 to 10, and x1 is an integer of 1 to 10, and x2 is an integer of 1 to 10, a metal-based detergent (C) that is at least one selected from a metal sulfonate (C1) having a branched alkyl group and a metal phenate (C2) having a branched alkyl group, and a zinc dithiophosphate (D), wherein the content of a phosphorus atom derived from the component (D) is less than 800 ppm by mass on the basis of the total amount of the lubricating oil composition.

Advantageous Effects of Invention

In accordance with the present invention, it is possible to provide a lubricating oil composition which even in the case of reducing the content of the phosphorus atom derived from the anti-wear agent, is capable of revealing excellent wear resistance in an internal combustion engine and a high friction coefficient in a wet clutch, and a method for producing the same.

DESCRIPTION OF EMBODIMENTS

In this specification, regarding a preferred numerical value range (for example, a range of the content or the like), a lower limit value and an upper limit value that are expressed in stages can be combined each independently. For example, from an expression of "preferably 10 to 90, and more preferably 30 to 60", by combining the "preferred lower limit value (10)" and the "more preferred upper limit value (60)", a suitable range can also be conceived as "10 to 60". Similarly, in this specification, it should be conceived that numerical values of "or more", "or less", "less than", and "more than" regarding the description of numerical value ranges are numerical values which can be arbitrarily combined with each other.

In addition, in the following description, the expression "wear resistance" means wear resistance in an internal combustion engine, and the expression "clutch friction characteristics" means properties of revealing a high friction coefficient in a wet clutch.

In this specification, the content of each of a phosphorus atom, a calcium atom, and a molybdenum atom means a value measured in conformity with JPI-5S-38-03.

The content of a nitrogen atom means a value measured in conformity with JIS K2609.

[Lubricating Oil Composition]

The lubricating oil composition of the present embodiment is a lubricating oil composition to be used for internal combustion engines, the lubricating oil composition containing a base oil (A), an imide compound (B) that is at least one selected from a succinic acid monoimide (B1) represented by the foregoing general formula (b-1) and a succinic acid bisimide (B2) represented by the foregoing general formula (b-2), a metal-based detergent (C) that is at least one selected from a metal sulfonate (C1) having a branched alkyl group and a metal phenate (C2) having a branched alkyl group, and a zinc dithiophosphate (D), wherein the content of a phosphorus atom derived from the component (D) is less than 800 ppm by mass on the basis of the total amount of the lubricating oil composition.

Each of the components that are contained in the lubricating oil composition of the present embodiment is hereunder described.

<Base Oil (A)>

The base oil (A) that is contained in the lubricating oil composition of the present embodiment may be one containing at least one selected from a mineral oil and a synthetic oil.

Examples of the mineral oil include atmospheric residual oils obtained by subjecting a crude oil, such as a paraffinic crude oil, an intermediate base crude oil, and a naphthenic crude oil, to atmospheric distillation; distillates obtained by subjecting such an atmospheric residual oil to vacuum distillation; and mineral oils obtaining by subjecting the foregoing distillate to at least one refining treatment, such as solvent deasphalting, solvent extraction, hydrogenation, solvent dewaxing, catalytic dewaxing, and hydrorefining.

Examples of the synthetic oil include poly-α-olefins, such as an α-olefin homopolymer and α-olefin copolymers (for example, an α-olefin copolymer having 8 to 14 carbon atoms, e.g., an ethylene-α-olefin copolymer); isoparaffins; various esters, such as polyol esters and dibasic acid esters; various ethers, such as polyphenyl ethers; polyalkylene glycols; alkylbenzenes; alkylnaphthalenes; and GTL base oils obtained by isomerizing a wax (GTL wax (gas-to-liquids WAX)) produced from a natural gas by the Fischer-Tropsch process or the like.

As the base oil that is used in the present embodiment, base oils classified into Groups 2 and 3 in the base oil category by API (The American Petroleum Institute) are preferred, and base oils classified into Group 2 are more preferred.

The base oil (A) may be used alone or in combination of a plurality thereof, and the synthetic oil may be used alone or in combination of a plurality thereof. Furthermore, a combination of one or more of mineral oils and one or more of synthetic oils may be used.

Although the kinematic viscosity and the viscosity index of the base oil (A) are not particularly limited, from the viewpoint of making the wear resistance of the lubricating oil composition more favorable, it is preferred to regulate the kinematic viscosity and the viscosity index to the following ranges, respectively.

The kinematic viscosity at 100° C. of the base oil (A) is preferably 4.0 to 20.0 $mm^2/s$, more preferably 4.5 to 15.0 $mm^2/s$, and still more preferably 5.0 to 11.0 $mm^2/s$.

The viscosity index of the base oil (A) is preferably 80 or more, more preferably 90 or more, still more preferably 100 or more, and yet still more preferably 105 or more.

In this specification, the kinematic viscosity and the viscosity index mean values measured or calculated in conformity with JIS K2283:2000, respectively.

In the case where the base oil (A) is a mixed base oil containing two or more base oils, the kinematic viscosity and the viscosity index of the mixed base oil have only to fall within the aforementioned ranges, respectively.

In the lubricating oil composition of the present embodiment, though the content of the base oil (A) is not particularly limited, from the viewpoint of making the wear resistance more favorable, it is preferably 60 to 99% by mass, more preferably 70 to 98% by mass, and still more preferably 80 to 97% by mass on the basis of the total amount (100% by mass) of the lubricating oil composition.

<Imide Compound (B)>

The imide compound (B) is at least one selected from a succinic acid monoimide (B1) represented by the following general formula (b-1) and a succinic acid bisimide (B2) represented by the following general formula (b-2).

The component (B) is one classified into an ash-free dispersant in the lubricating oil composition of the present embodiment. The component (B) has a structure in which at least a part of active amine hydrogens contained in the succinic acid monoimide or succinic acid bisimide compound produced using a polyamine compound as a raw material is substituted with a substituent, such as an alkyl group ($R^C$ in the general formulae (b-1) and (b-2)).

In the lubricating oil composition of the present embodiment, when using the component (B), excellent wear resistance and clutch friction characteristics can be revealed. As one reason for this, it may be considered that while in the succinic acid imide having active amine hydrogens, the active amine hydrogens coordinate to the zinc dithiophosphate (D) to inhibit the effect for improving the wear resistance of the component (D), when the active amine hydrogens are substituted with a substituent having low reactivity, the aforementioned coordination is inhibited, thereby bringing about the original effect for improving the wear resistance of the component (D).

At the same time, though a detailed mechanism is not elucidated yet, in the case of jointly using the metal-based detergent (C), the component (B) brings about a synergistic effect such that the wear resistance is remarkably improved while maintaining the favorable clutch friction characteristics.

(b-1)

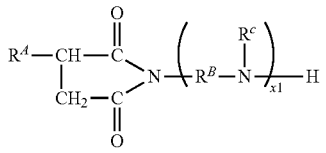

-continued (b-2)

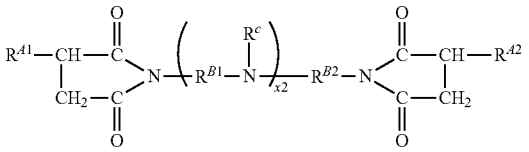

In the general formulae (b-1) and (b-2), $R^A$, $R^{A1}$, and $R^{A2}$ are each independently an alkenyl group having a mass average molecular weight (Mw) of 500 to 4,000.

Examples of the alkenyl group include a polybutenyl group, a polyisobutenyl group, and an ethylene-propylene copolymer. Of these, a polybutenyl group or a polyisobutenyl group is preferred.

The mass average molecular weight (Mw) of the alkenyl group is 500 to 4,000, preferably 900 to 3,000, more preferably 1,300 to 2,500, and still more preferably 1,800 to 2,400.

In the present invention, the mass average molecular weight (Mw) of the alkenyl group can be evaluated as a mass average molecular weight (Mw) as expressed in terms of standard polystyrene by, for example, measuring a polyolefin as a generation of the alkenyl group by using a GPC apparatus, manufactured by Tosoh Corporation (HLC-8220 Model) having columns, manufactured by Tosoh Corporation (two TSKgel GMH-XL and one TSKgel 2000H-XL) installed therewith under a condition of a detector: refractive index detector, a measurement temperature: 40° C., a mobile phase: tetrahydrofuran, a flow rate: 1.0 mL/min, and a concentration: 0.5 mg/mL.

As another method, a value obtained by subtracting a theoretical molecular weight of a structure corresponding to other group than the alkenyl group from the mass average molecular weight of the component (B) measured by the same measurement method as that as mentioned above and then dividing by the number of alkenyl group contained in one molecule can be determined as the mass average molecular weight (Mw) of the alkenyl group.

$R^B$, $R^{B1}$, and $R^{B2}$ are each independently an alkylene group having 2 to 5 carbon atoms.

Examples of the alkylene group include a methylene group, an ethylene group, a trimethylene group, various butylene groups, and various pentylene groups. In this specification, it should be construed that the expression "various" in the various butylene groups and so on includes linear groups, branched groups, and isomer groups thereof.

$R^C$ is an alkyl group having 1 to 10 carbon atoms or a group represented by $-(AO)_n-H$, wherein A represents an alkylene group having 2 to 4 carbon atoms, and n represents an integer of 1 to 10.

Examples of the alkyl group include linear or branched alkyl groups, such as a methyl group, an ethyl group, a propyl group, a butyl group, a pentyl group, a hexyl group, a heptyl group, an octyl group, a 1,1-dimethylhexyl group, a 2-ethylhexyl group, a nonyl group, a 1,1-dimethylheptyl group, and a decyl group.

Examples of the alkylene group having 2 to 4 carbon atoms, which is represented by A, include a methylene group, an ethylene group, a trimethylene group, and various butylene groups. Of these, an ethylene group is preferred.

n is preferably an integer of 1 to 5, and more preferably an integer of 2 to 4.

x1 is an integer of 1 to 10, preferably an integer of 2 to 5, and more preferably 3 or 4.

x2 is an integer of 1 to 10, preferably an integer of 3 to 7, and more preferably 5 or 6.

As for the component (B), the component (B1) may be used alone or in combination of a plurality thereof, and the component (B2) may be used alone or in combination of a plurality thereof. Furthermore, a combination of one or more of the components (B1) and one or more of the components (B2) may be used.

The component (B) can be, for example, produced by reacting an alkenyl succinic anhydride obtained through a reaction between a polyolefin and maleic anhydride with a polyamine, to prepare an alkenyl succinic acid imide having active amine hydrogens (compound represented by the general formula (b-1) or the general formula (b-2), wherein $R^C$ is a hydrogen atom), and substituting at least a part of the active amine hydrogens into the group represented by $R^C$.

Although examples of the aforementioned polyolefin include polymers obtained through polymerization of one or more selected from α-olefins having 2 to 8 carbon atoms, a copolymer of isobutene and 1-butene is preferred.

Examples of the polyamine include single diamines, such as ethylenediamine, propylenediamine, butylenediamine, and pentylenediamine; polyalkylenepolyamines, such as diethylenetriamine, triethylenetetramine, tetraethylenepentamine, pentaethylenehexamine, di(methylethylene)triamine, dibutylenetriamine, tributylenetetramine, and pentapentylenehexamine; and piperazine derivatives, such as aminoethylpiperazine.

The substitution reaction of the active amine hydrogen may be performed by a known method, and examples thereof include a method of reacting the alkenyl succinic acid imide compound having active amine hydrogens with an alkyl halide capable of giving $R^C$ in the general formula (b-1) and the general formula (b-2).

In the lubricating oil composition of the present embodiment, though the content of the component (B) as expressed in terms of a nitrogen atom is not particularly limited, from the viewpoint of making the wear resistance and the clutch friction characteristics more favorable, it is preferably 100 to 1,000 ppm by mass, more preferably 120 to 800 ppm by mass, still more preferably 130 to 600 ppm by mass, and yet still more preferably 140 to 400 ppm by mass on the basis of the total amount of the lubricating oil composition.

In the lubricating oil composition of the present embodiment, it is preferred to adjust the content of the component (B) such that the content as expressed in terms of a nitrogen atom falls within the aforementioned range, and specifically, from the viewpoint of making the wear resistance and the clutch friction characteristics more favorable, it is preferably 1.0 to 10.0% by mass, more preferably 1.2 to 8.0% by mass, still more preferably 1.3 to 6.0% by mass, and yet still more preferably 1.4 to 4.0% by mass on the basis of the total amount (100% by mass) of the lubricating oil composition.

The lubricating oil composition of the present embodiment may contain other ash-free dispersant than the component (B) within a range where the effects of the present invention are not impaired, or it may not contain other ash-free dispersant than the component (B).

Examples of the other ash-free dispersant include the following component (B') and a boron compound thereof, a benzylamine, a boron-containing benzylamine, a succinic acid ester, and a monovalent or divalent carboxylic acid amide represented by a fatty acid or succinic acid.

In the lubricating oil composition of the present embodiment, from the viewpoint of making the wear resistance and the clutch friction characteristics more favorable, the content of the component (B) in the ash-free dispersant is preferably 70 to 100% by mass, more preferably 80 to 100% by mass, still more preferably 90 to 100% by mass, and yet still more preferably 95 to 100% by mass relative to the total amount (100% by mass) of the ash-free dispersant contained in the lubricating oil composition.

In the lubricating oil composition of the present embodiment, the total content of a succinic acid monoimide represented by the following general formula (i) and a succinic acid bisimide represented by the following general formula (ii) (these will be hereinafter also referred to as "component (B')") is preferably less than 10 parts by mass, more preferably less than 5 parts by mass, and still more preferably less than 1 part by mass based on 100 parts by mass of the total amount of the component (B), from the viewpoint of making the wear resistance more preferable. In addition, the lubricating oil composition of the present embodiment may also be one not containing the component (B').

(i)

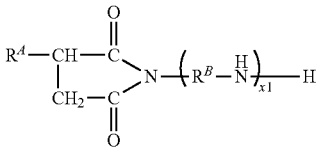

(ii)

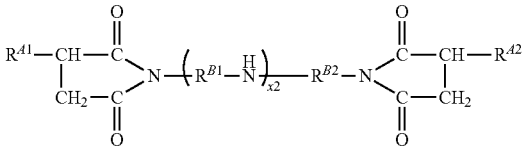

In the general formulae (i) and (ii), $R^A$, $R^{A1}$, $R^{A2}$, $R^B$, $R^{B1}$, $R^{B2}$, x1, and x2 are the same as in the general formulae (b-1) and (b-2).

<Metal-Based Detergent (C)>

The metal-based detergent (C) is at least one selected from a metal sulfonate (C1) having a branched alkyl group and a metal phenate (C2) having a branched alkyl group.

In view of the fact that the lubricating oil composition of the present embodiment contains the component (C), the friction coefficient of clutch can be made high. It may be conjectured that this is caused due to the fact that the component (C) is one having a branched alkyl group, whereby its resistance to a shear force is larger than that in a compound having a linear alkyl group.

At the same time, though a detailed mechanism is not elucidated yet, in the case of jointly using the component (B), the component (C) brings about a synergistic effect such that the wear resistance is remarkably improved while giving the excellent clutch friction characteristics.

From the viewpoint of an improvement of detergency, the metal atom contained in the metal-based detergency (C) is preferably a metal atom selected from an alkali metal atom and an alkaline earth metal atom; preferably a sodium atom, a calcium atom, a magnesium atom, or a barium atom; more preferably a calcium atom or a magnesium atom; and still more preferably a calcium atom. Namely, the metal-based detergent (C) is preferably at least one selected from a calcium sulfonate having a branched alkyl group and a calcium phenate having a branched alkyl group (these will be hereinafter also referred as "calcium-based detergent").

The content of the calcium-based detergent in the metal-based detergent (C) is preferably 70 to 100% by mass, more preferably 80 to 100% by mass, still more preferably 90 to 100% by mass, and yet still more preferably 95 to 100% by mass relative to the total amount (100% by mass) of the metal-based detergent (C) contained in the lubricating oil composition.

The carbon number of the branched alkyl group included in each of the component (C1) and the component (C2) is preferably 3 to 26, more preferably 7 to 24, and still more preferably 10 to 20.

The carbon number of the branched chain included in the branched alkyl group is preferably 1 to 8, more preferably 2 to 6, and still more preferably 2 to 5.

The metal sulfonate (C1) having a branched alkyl group is preferably a compound represented by the following general formula (c-1), and the metal phenate (C2) having a branched alkyl group is preferably a compound represented by the following general formula (c-2).

(c-1)

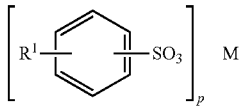

(c-2)

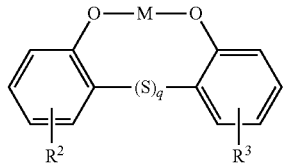

In the general formulae (c-1) and (c-2), M is a metal atom selected from an alkali metal atom and an alkaline earth metal atom; preferably a sodium atom, a calcium atom, a magnesium atom, or a barium atom; more preferably a calcium atom or a magnesium atom; and still more preferably a calcium atom, p is a valence of M and is 1 or 2.

q is an integer of 0 or more, and preferably an integer of 0 to 3.

$R^1$ to $R^3$ are each independently a branched alkyl group.

The carbon number of the aforementioned branched alkyl group is preferably 3 to 26, more preferably 7 to 24, and still more preferably 10 to 20. The carbon number of the branched chain included in the branched alkyl group is preferably 1 to 8, more preferably 2 to 6, and still more preferably 2 to 5.

As for the component (C), the component (C1) may be used alone or in combination of a plurality thereof, and the component (C2) may be used alone or in combination of a plurality thereof. Furthermore, a combination of one or more of the components (C1) and one or more of the components (C2) may be used.

The metal-based detergent (C) may be any of a neutral salt, a basic salt, an overbased salt, and a mixture thereof.

In the case where the metal-based detergent (C) is a neutral salt, a base number of the neutral salt is preferably 0 to 30 mgKOH/g, more preferably 0 to 25 mgKOH/g, and still more preferably 0 to 20 mgKOH/g.

In the case where the metal-based detergent (C) is a basic salt or an overbased salt, a base number of the basic salt or overbased salt is preferably 100 to 600 mgKOH/g, more preferably 120 to 550 mgKOH/g, still more preferably 160 to 500 mgKOH/g, and yet still more preferably 200 to 450 mgKOH/g.

In this specification, the "base number" means a base number measured by the perchloric acid method in conformity with Item 7 of JIS K2501 "Petroleum Products and Lubricating Oils-Neutralization Number Testing Method."

In the lubricating oil composition of the present embodiment, though the content of the component (C) as expressed in terms of a metal atom is not particularly limited, from the viewpoint of making the wear resistance and the clutch friction characteristics more favorable, it is preferably 100 to 5,000 ppm by mass, more preferably 200 to 4,000 ppm by mass, still more preferably 300 to 3,000 ppm by mass, and yet still more preferably 500 to 2,500 ppm by mass on the basis of the total amount of the lubricating oil composition.

In the lubricating oil composition of the present embodiment, it is preferred to adjust the content of the component (C) such that the content as expressed in terms of a metal atom falls within the aforementioned range, and specifically, from the viewpoint of making the wear resistance and the clutch friction characteristics more favorable, it is preferably 0.1 to 6.0% by mass, more preferably 0.3 to 4.0% by mass, still more preferably 0.4 to 3.5% by mass, and yet still more preferably 0.5 to 2.5% by mass on the basis of the total amount (100% by mass) of the lubricating oil composition.

In the lubricating oil composition of the present embodiment, from the viewpoint of making the wear resistance and the clutch friction characteristics more favorable, a content ratio [N/M] of the nitrogen atom (N) derived from the component (B) to the metal atom (M) derived from the component (C) is preferably 0.05 to 2.00, more preferably 0.06 to 0.50, and still preferably 0.07 to 0.40 in terms of a mass ratio.

The lubricating oil composition of the present embodiment may contain other metal-based detergent than the component (C) within a range where the effects of the present invention are not impaired, or it may not contain other metal-based detergent than the component (C).

Examples of the other metal-based detergent include a metal salicylate and a metal-based detergent having a linear alkyl group.

In the lubricating oil composition of the present embodiment, from the viewpoint of making the clutch friction characteristics more favorable, the content of the metal salicylate is preferably less than 10 parts by mass, more preferably less than 5 parts by mass, and still more preferably less than 1 part by mass based on 100 parts by mass of the total amount of the component (C). In addition, the lubricating oil composition of the present embodiment may not contain the metal salicylate.

In the lubricating oil composition of the present embodiment, from the viewpoint of making the wear resistance and the clutch friction characteristics more favorable, the content of the metal-based detergent having a linear alkyl group is preferably less than 10 parts by mass, more preferably less than 5 parts by mass, and still more preferably less than 1 part by mass based on 100 parts by mass of the total amount of the component (C). In addition, the lubricating oil composition of the present embodiment may not contain the metal-based detergent having a linear alkyl group.

<Zinc Dithiophosphate (D)>

The lubricating oil composition of the present embodiment is one further containing a zinc dithiophosphate (D).

Although the zinc dithiophosphate (D) has an effect for improving the wear resistance, in the lubricating oil composition of the present embodiment, even in the case where by jointly using the component (B) and the component (C), the content of the component (D) is reduced, and the content of phosphorus derived from the component (D) is regulated to less than 800 ppm by mass on the basis of the total amount of the lubricating oil composition, the excellent wear resistance and clutch friction characteristics can be obtained. The zinc dithiophosphate (D) may be used alone or may be used in combination of two or more thereof.

Examples of the zinc dithiophosphate (D) include a compound represented by the following general formula (d-1).

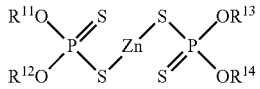

(d-1)

In the formula, $R^{11}$ to $R^{14}$ each independently represent a hydrocarbon group having 1 to 24 carbon atoms.

Examples of the hydrocarbon group represented by each of $R^{11}$ to $R^{14}$ include a linear or branched alkyl group having 1 to 24 carbon atoms, a linear or branched alkenyl group having 3 to 24 carbon atoms, a cycloalkyl group or a linear or branched alkylcycloalkyl group each having 5 to 13 carbon atoms, an aryl group or a linear or branched alkylaryl group each having 6 to 18 carbon atoms, and an arylalkyl group having 7 to 19 carbon atoms. Of these, a linear or branched alkyl group having 1 to 24 carbon atoms is preferred, and a branched alkyl group having 1 to 24 carbon atoms is more preferred. The carbon number of the branched alkyl group is preferably 2 to 12, and more preferably 3 to 6. Examples of the branched alkyl group having 1 to 24 carbon atoms include an isopropyl group, an isobutyl group, a sec-butyl group, a tertbutyl group, an isopentyl group, a tert-pentyl group, an isohexyl group, a 2-ethylhexyl group, an isononyl group, an isodecyl group, an isotridecyl group, an isostearyl group, and an isoeicosyl group. Of these, a sec-butyl group is preferred.

As the zinc dithiophosphate (D), specifically, a zinc dialkyldithiophosphate is preferred, and above all, a zinc secondary dialkyldithiophosphate is more preferred.

In the lubricating oil composition of the present embodiment, though the content of the phosphorus atom derived from the component (D) is not particularly limited so long as it is less than 800 ppm by mass on the basis of the total amount of the lubricating oil composition, from the viewpoint of inhibition of poisoning of the exhaust gas catalyst, it is preferably less than 700 ppm by mass, more preferably less than 650 ppm by mass, and still more preferably less than 620 ppm by mass, and from the viewpoint of an improvement of wear resistance, it is preferably 100 ppm by mass or more, and more preferably 400 ppm by mass or more.

In the lubricating oil composition of the present embodiment, it is preferred to adjust the content of the zinc dithiophosphate (D) such that the content as expressed in terms of a phosphorus atom falls within the aforementioned range, and specifically, from the viewpoint of inhibition of poisoning of the exhaust gas catalyst, it is preferably less than 1.0% by mass, more preferably less than 0.9% by mass, and still more preferably less than 0.8% by mass on the basis of the total amount (100% by mass) of the lubricating oil composition, and from the viewpoint of an improvement of wear resistance, it is preferably 0.1% by mass or more, and more preferably 0.5% by mass or more.

<Other Additive for Lubricating Oil>

The lubricating oil composition of the present embodiment may contain other additive for lubricating oil than the aforementioned components within a range where the effects of the present invention are not impaired.

Examples of the other additive for lubricating oil include an antioxidant, a viscosity index improver, a pour point depressant, an anti wear agent, an extreme pressure agent, a metal-based friction modifier, a rust inhibitor, a metal deactivator, a demulsifier, and an anti-foaming agent.

Each of such additives for lubricating oil may be used alone or may be used in combination of two or more thereof.

Examples of the antioxidant include an amine-based antioxidant, a phenol-based antioxidant, a molybdenum-based antioxidant, a sulfur-based antioxidant, and a phosphorus-based antioxidant. Of these, at least one selected from an amine-based antioxidant and a phenol-based antioxidant is preferred.

Examples of the viscosity index improver include polymers, such as a non-dispersion type polymethacrylate, a dispersion type polymethacrylate, an olefin-based copolymer (for example, an ethylene-propylene copolymer), a dispersion type olefin-based copolymer, and a styrene-based copolymer (for example, a styrene-diene copolymer and a styrene-isoprene copolymer).

Examples of the pour-point depressant include an ethylene-vinyl acetate copolymer, a condensate of a chlorinated paraffin and naphthalene, a condensate of a chlorinated paraffin and phenol, a polymethacrylate, and a polyalkylstyrene.

Examples of the anti-wear agent or the extreme pressure agent include sulfur-containing compounds, such as molybdenum dithiocarbamate, molybdenum dithiophosphate, disulfides, sulfurized olefins, sulfurized oils and fats, sulfurized esters, thiocarbonates, thiocarbamates, and polysulfides; phosphorus-containing compounds, such as phosphorous acid esters, phosphoric acid esters, phosphonic acid esters, and amine salts or metal salts thereof; and sulfur- and phosphorus-containing compounds, such as thiophosphorous acid esters, thiophosphoric acid esters, thiophosphonic acid esters, and amine salts or metal salts thereof.

Examples of the metal-based friction modifier include molybdenum based friction modifiers, such as molybdenum dithiocarbamate (MoDTC), molybdenum dithiophosphate (MoDTP), and amine salts of molybdic acid.

However, as for the lubricating oil composition of the present embodiment, from the viewpoint of obtaining the excellent clutch friction characteristics, it is preferred that the content of the molybdenum-based friction modifier is small as far as possible. In the lubricating oil composition of the present embodiment, the content of the molybdenum atom is preferably less than 50 ppm by mass, more preferably less than 30 ppm by mass, and still more preferably less than 10 ppm by mass on the basis of the total amount of the lubricating oil composition. In addition, the lubricating oil composition may be one not containing a molybdenum atom.

Examples of the rust inhibitor include fatty acids, alkenylsuccinic acid half esters, fatty acid soaps, alkylsulfonic acid salts, polyhydric alcohol fatty acid esters, fatty acid amines, oxidized paraffins, and alkyl polyoxyethylene ethers.

Examples of the metal deactivator include benzotriazole-based compounds, tolyltriazole-based compounds, thiadiazole-based compounds, imidazole-based compounds, and pyrimidine-based compounds.

Examples of the demulsifier include anionic surfactants, such as sulfuric acid ester salts of castor oil and petroleum sulfonic acid salts; cationic surfactants, such as quaternary ammonium salts and imidazolines; polyoxyalkylene polyglycols and dicarboxylic acid esters thereof; and alkylene oxide adducts of an alkylphenol-formaldehyde polycondensate.

Examples of the anti-foaming agent include silicone oils, fluorosilicone oils, and fluoroalkyl ethers.

With respect to each of the aforementioned other additives for lubricating oil, though the content thereof can be appropriately adjusted within a range where the effects of the present invention are not impaired, it is typically 0.001 to 15% by mass, preferably 0.005 to 10% by mass, more preferably 0.01 to 7% by mass, and still more preferably 0.03 to 5% by mass on the basis of the total amount (100% by mass) of the lubricating oil composition. In this specification, taking into consideration handling properties, solubility in the base oil (A), and so on, the additive, such as a viscosity index improver and an anti-foaming agent, may be blended in a form of a solution having been diluted with and dissolved in a part of the based oil (A), with other components. In such a case, in this specification, the aforementioned content of the additive, such as an anti-foaming agent and a viscosity index improver, means the content as expressed in terms of the effective component excluding a diluent oil (expressed in terms of the resin content).

In the lubricating oil composition of the present embodiment, the total content of the component (A), the component (B), the compound (C), and the compound (D) is preferably 60% by mass or more, more preferably 70% by mass or more, still more preferably 80% by mass or more, and yet still more preferably 90% by mass or more, and it is typically 100% by mass or less, on the basis of the total amount (100% by mass) of the lubricating oil composition.

[Various Properties of Lubricating Oil Composition]

The kinematic viscosity at 100° C. of the lubricating oil composition of the present embodiment is preferably 8.0 to 20.0 $mm^2/s$, more preferably 9.0 to 18.0 $mm^2/s$, and still more preferably 10.0 to 15.0 $mm^2/s$.

The kinematic viscosity at 40° C. of the lubricating oil composition of the present embodiment is preferably 40.0 to 140.0 $mm^2/s$, more preferably 60.0 to 130.0 $mm^2/s$, and still more preferably 80.0 to 120.0 $mm^2/s$.

The viscosity index of the lubricating oil composition of the present embodiment is preferably 80 or more, more preferably 85 or more, still more preferably 90 or more, and yet still more preferably 95 or more.

In the lubricating oil composition of the present embodiment, a wear width measured based on the method and condition in the section of Examples as mentioned later is preferably 150 μm or less, more preferably 140 μm or less, still more preferably 135 μm or less, and yet still more preferably 130 μm or less. Although a lower limit value of the wear width is not particularly limited, taking into consideration a balance with other characteristics, it may be 100 μm or more.

In the lubricating oil composition of the present embodiment, a friction coefficient measured based on the method and condition in the section of Examples as mentioned later is preferably 0.147 or more, more preferably 0.148 or more, still more preferably 0.149 or more, and yet still more preferably 0.150 or more. Although an upper limit value of the friction coefficient is not particularly limited, taking into consideration a balance with other characteristics, it may be 0.200 or less.

In the lubricating oil composition of the present embodiment, from the viewpoint of reducing a load against an exhaust gas post-treatment apparatus, the content of the phosphorus atom is preferably less than 700 ppm by mass, more preferably less than 650 ppm by mass, and still more preferably less than 620 ppm by mass on the basis of the total amount of the lubricating oil composition.

[Application of Lubricating Oil Composition]

As for the lubricating oil composition of the present embodiment, even in the case where the content of the phosphorus atom derived from the anti-wear agent is reduced, it is able to reveal the excellent wear resistance in an internal combustion engine and the high friction coefficient in a wet type clutch.

While the lubricating oil composition of the present embodiment is one to be used for internal combustion engines, in particular, it is preferably provided for a lubricating oil for engine to be used for internal combustion engines of a motorcycle. In the lubricating oil composition of the present embodiment, the content of the phosphorus atom is reduced, and therefore, it is also preferred that the lubricating oil composition of the present embodiment is used for internal combustion engines equipped with a post-treatment apparatus containing an exhaust gas catalyst.

The present embodiment may also provide an internal combustion engine as set forth in the following [1] and a method of use as set forth in the following [2], An internal combustion engine using a lubricating oil composition, the lubricating oil composition containing a base oil (A), an imide compound (B) that is at least one selected from a succinic acid monoimide (B1) represented by the foregoing general formula (b-1) and a succinic acid bisimide (B2) represented by the foregoing general formula (b-2), a metal-based detergent (C) that is at least one selected from a metal sulfonate (C1) having a branched alkyl group and a metal phenate (C2) having a branched alkyl group, and a zinc dithiophosphate (D), wherein the content of a phosphorus atom derived from the component (D) is less than 800 ppm by mass on the basis of the total amount of the lubricating oil composition.

A method of use of a lubricating oil composition to be used for internal combustion engines, the lubricating oil composition containing a base oil (A), an imide compound (B) that is at least one selected from a succinic acid monoimide (B1) represented by the foregoing general formula (b-1) and a succinic acid bisimide (B2) represented by the foregoing general formula (b-2), a metal-based detergent (C) that is at least one selected from a metal sulfonate (C1) having a branched alkyl group and a metal phenate (C2) having a branched alkyl group, and a zinc dithiophosphate (D), wherein the content of a phosphorus atom derived from the component (D) is less than 800 ppm by mass on the basis of the total amount of the lubricating oil composition.

With respect to the lubricating oil composition to be used in the above [1] and [2], suitable modes of the respective components, suitable properties of the lubricating oil composition, and so on are those as mentioned above.

The internal combustion engine described in the above [1] and [2] is more preferably an internal combustion engine of a motorcycle.

[Production Method of Lubricating Oil Composition]

The present embodiment also provides a method for producing a lubricating oil composition to be used for internal combustion engines, the method including mixing a base oil (A), an imide compound (B) that is at least one selected from a succinic acid monoimide (B1) represented by the foregoing general formula (b-1) and a succinic acid bisimide (B2) represented by the foregoing general formula (b-2), a metal-based detergent (C) that is at least one selected from a metal sulfonate (C1) having a branched alkyl group and a metal phenate (C2) having a branched alkyl group, and a zinc dithiophosphate (D), wherein the content of a phosphorus atom derived from the component (D) is less than 800 ppm by mass on the basis of the total amount of the lubricating oil composition.

Although the method of mixing the aforementioned respective components is not particularly limited, examples thereof include a method including a step of blending the base oil (A) with the component (B), the component (C), and the component (D). In addition, the aforementioned other additive for lubricating oil may be simultaneously blended together with the components (A) to (D). In addition, each of the components may be blended after being converted into a form of a solution (dispersion) upon addition with a diluent oil or the like. It is preferred that after blending the respective components, the blend is stirred and uniformly dispersed by a known method.

EXAMPLES

Next, the present invention is described in more detail by reference to Examples, but it should be construed that the present invention is by no means limited by these Examples. Various properties of the respective components used in the Examples and Comparative Examples and the obtained lubricating oil compositions were measured according to the following methods.

<Kinematic Viscosity and Viscosity Index>

Measured in conformity with JIS K2283:2000.

<Base Number (Perchloric Acid Method)>

Measured in conformity with JIS K2501.

<Content of Each of Phosphorus Atom, Calcium Atom, and Molybdenum Atom>

Measured in conformity with JPI-5S-38-03.

<Content of Nitrogen Atom>

Measured in conformity with JIS K2609.

Examples 1 to 7 and Comparative Examples 1 to 4

The following base oil and various additives were added in blending amounts shown in Table 1 and thoroughly mixed to prepare lubricating oil compositions, respectively.

Details of the base oil and various additives used in the Examples and Comparative Examples are as follows.

(Component (A))

"Base Oil (a)":

500N mineral oil having been subjected to hydrorefining, which is classified into Group 2 by the API base oil category, kinematic viscosity at 40° C.=91.4 $mm^2/s$, kinematic viscosity at 100° C.=10.5 $mm^2/s$, viscosity index=97

(Component (B))

Component (B2) "Modified Alkenyl Succinic Acid Bisimide":

Succinic acid bisimide represented by the foregoing general formula (b-2) (in the formula, $R^{A1}$ and $R^{A2}$ are each a polybutenyl group having a mass average molecular weight (Mw) of 2,300; $R^{B1}$ and $R^{B2}$ are each an ethylene group; x2 is 5; and $R^C$ is a group represented by —$CH_2CH_2OCH_2CH_2OH$), content of nitrogen atom=1.0% by mass.

(Component (B'))

Comparative Component "Unmodified Alkenyl Succinic Acid Bisimide":

Succinic acid bisimide represented by the foregoing general formula (ii) (in the formula, $R^{A1}$ and $R^{A2}$ are each a polybutenyl group having a mass average molecular weight (Mw) of 950; $R^{B1}$ and $R^{B2}$ are each an ethylene group; and x2 is 3), content of nitrogen atom=1.9% by mass.

Comparative Component "Unmodified Alkenyl Succinic Acid Monoimide":

Succinic acid monoimide represented by the foregoing general formula (i) (in the formula (i), $R^A$ is a polybutenyl group having a mass average molecular weight (Mw) of 950; $R^B$ is an ethylene group; and x1 is 3), content of nitrogen atom=1.8% by mass.

(Component (C))

Component (C1) "Branched Type Ca Sulfonate":

Calcium sulfonate having a branched alkyl group (alkyl group mainly having 16 carbon atoms and having a branched chain of a butyl group in the molecular structure), base number=300 mgKOH/g, content of calcium atom=11.6% by mass Component (C2) "Branched Type Ca Phenate":

Calcium phenate having a branched alkyl group (alkyl group mainly having 12 carbon atoms and having a branched chain of an ethyl group and/or a propyl group in the molecular structure), base number=250 mgKOH/g, content of calcium atom=9.3% by mass.

(Component (C'))

Comparative Component "Linear Type Ca Sulfonate":

Calcium sulfonate having a linear alkyl group (linear alkyl group mainly having 16 carbon atoms), base number=300 mgKOH/g, content of calcium atom=11.9% by mass.

(Component (D))

ZnDTP:

Zinc dialkyldithiophosphate having a secbutyl group as an alkyl group (alkyl compound represented by the general formula (d-1) wherein $R^{11}$ to $R^{14}$ are each a sec-butyl group), content of phosphorus atom=7.1% by mass.

(Other Additive for Lubricating Oil)

Amine-Based Antioxidant:

Dinonyl Diphenylamine

With respect to the lubricating oil compositions prepared, the following tests were performed. The results thereof are shown in Table 1.

[Evaluation of Wear Resistance]

Using an SRV experiment machine (manufactured by Optimol Instruments Prüftechnik GmbH), the prepared lubricating oil compositions were each subjected to a friction test under the following condition, and a wear width (mm) in the cylinder center after elapsing the test time was measured. The smaller the wear width, the more excellent the wear resistance, and when the wear width was 150 μm or less, the wear resistance was judged to be favorable.

Material of cylinder: SUJ-2
Material of disc: SUJ-2
Frequency: 50 Hz
Amplitude: 1.5 mm
Load: 400 N
Oil temperature: 80° C.
Test time: 60 minutes

[Evaluation of Friction Coefficient]

Using an MTM (mini traction machine) experiment machine, the friction coefficient was measured under the following condition. As for the value of the friction coefficient, when the friction coefficient under the same condition of JAFRE A16 (standard oil) was 0.147 or more, the friction coefficient was judged to be favorable.

Test piece: Standard test piece AISI 52100 (¾-inch ball)
Disc: One prepared by sticking a clutch material (R4 material) onto the surface of a steel-made disc
Pre-conditioning interim operation time: 10 minutes
Load: 3 N
Oil temperature: 100° C.
Rate: 100 mm/s
Slip rate (SRR): 200%

TABLE 1

| | | | | Example 1 | Example 2 | Example 3 | Example 4 | Example 5 | Example 6 | Example 7 | Comparative Example 1 | Comparative Example 2 | Comparative Example 3 | Comparative Example 4 |
|---|---|---|---|---|---|---|---|---|---|---|---|---|---|---|
| Composition | Component (A) | Base oil (a) | mass % | 93.95 | 93.50 | 95.45 | 90.95 | 94.81 | 93.10 | 94.68 | 95.41 | 95.28 | 93.98 | 95.44 |
| | Component (B) | Component (B2): Modified alkenyl succinic acid bisimide | mass % | 3.00 | 3.00 | 1.50 | 6.00 | 3.00 | 3.00 | 1.50 | — | — | 3.00 | — |
| | Component (B') | Comparative component: Unmodified alkenyl succinic acid bisimide | mass % | — | — | — | — | — | — | 0.77 | 1.54 | — | — | 1.54 |
| | | Comparative component: Unmodified alkenyl succinic acid monoimide | mass % | — | — | — | — | — | — | — | — | 1.67 | — | — |
| | Component (C) | Component (C1): Branched type Ca sulfonate | mass % | 1.71 | — | 1.71 | 1.71 | 0.85 | 2.56 | 1.71 | 1.71 | 1.71 | — | — |
| | | Component (C2): Branched type Ca phenate | mass % | — | 2.16 | — | — | — | — | — | — | — | — | — |
| | Component (C') | Comparative component: Linear type Ca sulfonate | mass % | — | — | — | — | — | — | — | — | — | 1.68 | 1.68 |
| | Component (D) | ZnDTP | mass % | 0.84 | 0.84 | 0.84 | 0.84 | 0.84 | 0.84 | 0.84 | 0.84 | 0.84 | 0.84 | 0.84 |
| | Other component | Amine-based antioxidant | mass % | 0.50 | 0.50 | 0.50 | 0.50 | 0.50 | 0.50 | 0.50 | 0.50 | 0.50 | 0.50 | 0.50 |
| | — | Total | mass % | 100.0 | 100.0 | 100.0 | 100.0 | 100.0 | 100.0 | 100.0 | 100.0 | 100.0 | 100.0 | 100.0 |
| Content of phosphorus atom derived from component (D) (on the basis of the total amount of lubricating oil composition) | | | ppm by mass | 600 | 600 | 600 | 600 | 600 | 600 | 600 | 600 | 600 | 600 | 600 |
| Content of component (B) as expressed in terms of a nitrogen atom (on the basis of the total amount of lubricating oil composition) | | | ppm by mass | 300 | 300 | 150 | 600 | 300 | 300 | 150 | 0 | 0 | 300 | 0 |
| Content of component (B') as expressed in terms of a nitrogen atom (on the basis of the total amount of lubricating oil composition) | | | ppm by mass | 0 | 0 | 0 | 0 | 0 | 0 | 150 | 300 | 300 | 0 | 300 |
| Content of component (B) in the total amount (100% by mass) of ash-free dispersant | | | mass % | 100 | 100 | 100 | 100 | 100 | 100 | 66 | 0 | 0 | 100 | 0 |
| Content of component (C) as expressed in terms of a metal atom (Ca) (on the basis of the total amount of lubricating oil composition) | | | ppm by mass | 2000 | 2000 | 2000 | 2000 | 1000 | 3000 | 2000 | 2000 | 2000 | 0 | 0 |
| Content of component (C') as expressed in terms of a metal atom (Ca) (on the basis of the total amount of lubricating oil composition) | | | ppm by mass | 0 | 0 | 0 | 0 | 0 | 0 | 0 | 0 | 0 | 2000 | 2000 |
| Content of calcium-based detergent in the total amount (100% by mass) of metal-based detergent (C) | | | mass % | 100 | 100 | 100 | 100 | 100 | 100 | 100 | 100 | 100 | 0 | 0 |
| Content ratio ⌊N/M⌋ of nitrogen atom derived from component (B) to metal atom derived from component (C) (on the basis of mass) | | | — | 0.15 | 0.15 | 0.08 | 0.30 | 0.30 | 0.10 | 0.08 | 0 | 0 | | |
| Content ratio ⌊N/M⌋ of nitrogen atom derived from component (B) and component (B') to metal atom derived from component (C) and component (C') (on the basis of mass) | | | — | 0.15 | 0.15 | 0.08 | 0.30 | 0.30 | 0.10 | 0.15 | 0.15 | 0.15 | 0.15 | 0.15 |
| Content of component (B') based on 100 parts by mass of component (B) | | | parts by mass | 0 | 0 | 0 | 0 | 0 | 0 | 51 | | | | |
| Content of component (C') based on 100 parts by mass of component (C) | | | parts by mass | 0 | 0 | 0 | 0 | 0 | 0 | 0 | 0 | 0 | | |
| Various properties of lubricating oil composition | | Kinematic viscosity (40° C.) | $mm^2/s$ | 105.4 | 106.1 | 98.6 | 118.6 | 103.5 | 106.0 | 102.2 | 98.85 | 100.5 | 103.9 | 98.8 |
| | | Kinematic viscosity (100° C.) | $mm^2/s$ | 11.78 | 11.83 | 11.15 | 12.99 | 11.60 | 11.84 | 11.45 | 11.13 | 11.25 | 11.69 | 11.07 |
| | | Viscosity index | — | 100 | 100 | 98 | 103 | 99 | 100 | 98 | 97 | 97 | 100 | 97 |
| Test item | Wear resistance | Wear width | μm | 122 | 124 | 119 | 134 | 124 | 132 | 135 | 152 | 186 | 182 | 194 |
| | Clutch friction characteristics | Friction coefficient | — | 0.153 | 0.163 | 0.156 | 0.149 | 0.152 | 0.153 | 0.156 | 0.153 | 0.153 | 0.144 | 0.145 |

The lubricating oil compositions prepared in Examples 1 to 7 were small in the wear width so that they were excellent in the wear resistance, and they also had a high friction coefficient even in the case where the content of the phosphorus atom derived from the anti-wear agent (component (D)) was reduced to 600 ppm by mass.

On the other hand, the lubricating oil compositions of Comparative Examples 1 and 2 each not using the component (B) were large in the wear width so that they were inferior in the wear resistance. In addition, the lubricating oil compositions of Comparative Examples 3 and 4 each not using the component (C) were large in the wear width so that they were interior in the wear resistance, and they were also low in the friction coefficient.

In addition, in comparison between Comparative Examples 3 and 4 each using the component (C'), the wear width in Comparative Example 3 using the component (B) was reduced by 12 μm as compared with that in Comparative Example 4 using the component (B'). On the other hand, in comparison between Comparative Example 1 and Example 1 each using the component (C), the wear width in Example 1 using the component (B) was reduced by 30 μm as compared with that in Comparative Example 1 using the component (B'). According to this, the lubricating oil composition of the present embodiment brings about a synergistic effect such that the wear resistance is remarkably improved while revealing a high friction coefficient even in the case where on the occasion of jointly using the component (B) and the component (C), the content of the phosphorus atom derived from the anti-wear agent is reduced.

The invention claimed is:

1. A lubricating oil composition, comprising:

a base oil (A);

an imide compound (B);

a metal-based detergent (C); and a zinc dithiophosphate (D), wherein the imide compound (B) is al least one selected from the group consisting of a succinic acid monoimide of formula (b-1) and a succinic acid bisimide of formula (b-2):

(b-1)

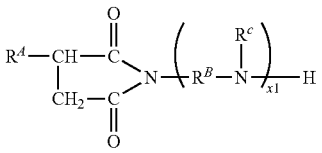

(b-2)

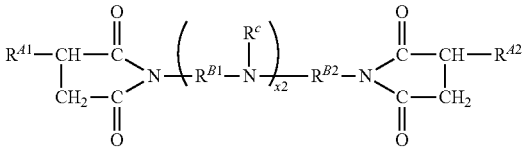

wherein $R^A$, $R^{A1}$, and $R^{A2}$ are each independently an alkenyl group having a mass average molecular weight of 500 to 4,000, $R^B$, $R^{B1}$, and $R^{B2}$ are each independently an alkylene group having 2 to 5 carbon atoms, $R^C$ is an alkyl group having 1 to 10 carbon atoms or an $-(AO)_n$—H group, A being an alkylene group having 2 to 4 carbon atoms, and n being an integer in a range of from 1 to 10, and x1 and x2 are independently an integer in a range of from 1 to 10, wherein the metal-based detergent (C) is at least one selected from the group consisting of a metal sulfonate (C1) having a branched alkyl group and a metal phenate (C2) having a branched alkyl group, and wherein a content of a phosphorus atom derived from the zinc dithiophosphate (D) is less than 800 ppm by mass on the basis of a total lubricating oil composition mass.

2. The composition of claim 1, wherein the content of the imide compound (B) as expressed in terms of a nitrogen atom is 100 to 1,000 ppm by mass on the basis of the total amount of the lubricating oil composition.

3. The composition of claim 1, wherein a total content of a succinic acid monoimide of formula (i) and a succinic acid bisimide of formula (ii) is less than 10 parts by mass based on 100 parts by mass of a total amount of the imide compound (B):

(i)

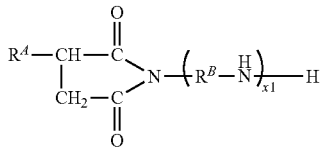

(ii)

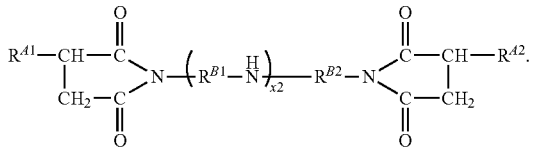

4. The composition of claim 1, wherein the content of the metal-based detergent (C) as expressed in terms of a metal atom is 100 to 5,000 ppm by mass on the basis of the total amount of the lubricating oil composition.

5. The composition of claim 1, wherein a content ratio [N/M] of a nitrogen atom (N) derived from the imide compound to a metal atom (M) derived from the metal-based detergent is 0.05 to 2.00 in terms of a mass ratio.

6. The composition of claim 1, wherein the metal-based detergent (C) is at least one selected from the group consisting of a calcium sulfonate having a branched alkyl group and a calcium phenate having a branched alkyl group.

7. The composition of claim 1, wherein a content of a metal-based detergent having a linear alkyl group is less than 10 parts by mass based on 100 parts by mass of a total amount of the metal-based detergent (C).

8. The composition of claim 1, wherein a content of a molybdenum atom is less than 50 ppm by mass on the basis of the total amount of the lubricating oil composition.

9. The composition of claim 1, wherein the metal-based detergent (C) comprises the metal sulfonate (C1) having the branched alkyl group.

10. A method for producing the lubricating oil composition of claim 1, the method comprising:

mixing the base oil (A), the imide compound (B), the metal-based detergent (C), and the zinc dithiophosphate (D).

11. The composition of claim 1, wherein the imide compound (B) comprises the succinic acid monoimide of formula (b-1).

12. The composition of claim 1, wherein the imide compound (B) comprises the succinic acid bisimide of formula (h-2).

13. The composition of claim 1, wherein the imide compound (B) comprises the succinic acid monoimide of formula (b-1) and the succinic acid bisimide of formula (b-2).

14. The composition of claim 1, comprising an ash-free dispersant, wherein the ash-free dispersant comprises no boron compound.

15. The composition of claim 1, wherein $R^C$ is the $-(AO)_n$—H group.

16. The composition of claim 1, wherein $R^C$ is the $-(AO)_n$—H group, with n being an integer in a range of from 2 to 4.

17. The composition of claim 1, wherein $R^C$ is the $-(AO)_n$—H group, with A being an ethylene group.

18. The composition of claim 1, wherein in (b-1) and (h-2), the alkenyl group of $R^A$, $R^{A1}$, and $R^{A2}$ independently have a mass average molecular weight (Mw) in a range of from 900 to 3,000.

19. The composition of claim 1, wherein, in mass percentage based on total lubricating oil composition mass;

the base oil (A) is present in a range of from 60 to 99%;

the imide compound (B) is present in a range of from 1.0 to 10%, the metal-based detergent (C) is present in a range of from 0.1 to 6.0%; and the zinc dithiophosphate (D) is present in a range of from 0.1 to 1.0%.

20. The composition of claim 1, wherein, based on total lubricating oil composition mass, the imide compound (B), expressed in terms of a nitrogen atom, is in a range of from 100 to 1,000 ppm by mass, and a content of the metal-based detergent (C), as expressed in terms of a metal atom, is in a range of from 100 to 5,000 ppm by mass.

* * * * *